United States Patent [19]

Baumeler et al.

[11] 4,452,009

[45] Jun. 5, 1984

[54] LIGHT BARRIER, PARTICULARLY FOR AUTOMATICALLY ACTUATED LIFT CABIN DOORS

[75] Inventors: Josef Baumeler, Horw; Hans-Ulrich Egli, Adligenswil, both of Switzerland

[73] Assignee: Inventio AG, Hergiswil, Switzerland

[21] Appl. No.: 443,374

[22] Filed: Nov. 22, 1982

[30] Foreign Application Priority Data

Dec. 3, 1981 [CH] Switzerland ..... 7725/81

[51] Int. Cl.[3] ..... E05F 15/20

[52] U.S. Cl. ..... 49/25; 49/28; 49/31; 187/52 R

[58] Field of Search ..... 49/31, 28, 25; 187/52 R, 51, 56, 52 LC

[56] References Cited

U.S. PATENT DOCUMENTS

| | | | |
|---|---|---|---|
| 3,063,516 | 11/1962 | Duncan et al. | 187/52 LC |
| 3,903,996 | 9/1975 | Berkovitz et al. | 49/25 X |
| 4,029,176 | 6/1977 | Mills | 49/25 X |

FOREIGN PATENT DOCUMENTS

| | | | |
|---|---|---|---|
| 684193 | 4/1964 | Canada | 49/25 |
| 3021363 | 12/1981 | Fed. Rep. of Germany | 49/28 |

*Primary Examiner*—Philip C. Kannan

*Attorney, Agent, or Firm*—Werner W. Kleeman

[57] ABSTRACT

A light barrier is restricted to detecting blockage in a limited, constant region before the closing edges of a lift cabin-twin door. Two light emitters or transmitters are displaceably arranged in the door sill and are operatively associated with entrainment elements fastened to the lift cabin doors. The light emitters are synchronously displaced with light receivers mounted at the upper edges of the cabin doors. To increase reliability of operation, the lower edges of the lift cabin doors are provided with cleaning devices which clean the light exit locations of infrared luminescent or light-emitting diodes forming the light emitters during every opening and closing operation. Thus, the cleaning device of one door is arranged to clean the infrared luminescent diode of the light emitter of the other door and vice versa.

6 Claims, 4 Drawing Figures

LIGHT BARRIER, PARTICULARLY FOR AUTOMATICALLY ACTUATED LIFT CABIN DOORS

BACKGROUND OF THE INVENTION

The present invention relates to a light barrier arrangement for automatically actuated lift cabin doors.

Generally speaking, such an arrangement includes at least one light receiver and at least one light emitter or transmitter connected with the lift cabin door and arranged to be displaced together with the same and with light beams or rays extending approximately vertically upwardly from the door sill. Any interruption in the light beam or radiation will generate a signal acting on the lift cabin door drive. In particular, the present invention also relates to a light barrier arrangement of the aforementioned type in combination with a lift or elevator cabin door which comprises two cabin doors defining a central closing line.

In a known light barrier arrangement as disclosed in German Pat. No. 1,007,036 a beam of light is caused to extend vertically along the closing line of an elevator or lift cabin having twin doors. The light emitter or transmitter is mounted above the door opening and the light receiver is mounted below the door sill. The protection offered by this type of light barrier is insufficient, since any persons passing laterally of the light beam will not be detected during the door closing movement. Also, in an arrangement of this type it is possible that the door control is interrupted unnecessarily and prematurely, so that there results a loss of time.

In a prior art light barrier arrangement as disclosed in U.S. Pat. No. 3,063,516 which contains a horizontally extending beam of light, the light emitter is mounted at one half of the cabin door and the light receiver at the other half of the cabin door. The cabin door halves comprise movable edges generating an additional protection which, when contacted, may interrupt the beam of light. Also in this case protection during closing movement of the cabin door is insufficient, and a premature and unnecessary interruption in the door control is possible due to the use of only one horizontally extending beam of light.

Part of the disadvantages mentioned above are avoided according to another known monitoring device for automatically closing lift cabin doors as disclosed in German Patent Publication No. 2,459,674. In this case, the door sill has a number of apertures distributed over the entire width of the door opening. Lenses are inserted into the apertures and light emitted from a light source passes through the lenses. Two light sensors or receivers of a light barrier arrangement which is independent of the door position are secured at the upper edge of the door opening at a distance of roughly 30 centimeters and symmetrically with respect to the door closing line. Two further light sensors or receivers associated with a light barrier responsive to the door position are also mounted at the upper edges of the doors. The last-mentioned light sensors or receivers are intended to respond to obstacles close to the door edge, for example, in a region up to 75 mm. It is a disadvantage of the light barrier arrangement which is independent of the door position that the door control may be prematurely interrupted. A further disadvantage is the relatively expensive manufacturing process for the door sill including the light exit apertures distributed over the entire width of the door which additionally are prone to being covered by dirt.

To avoid an unnecessary and premature interruption in the door control and also to thus save time, it is desirable to limit the detection of obstacles to a region adjacent to the closing edges of the door. Therefore, it has been contemplated for the light barrier arrangement depending on the door position in the monitoring device discussed heretofore with respect to German Patent Publication No. 2,456,674 to mount light emitters or transmitters at the lower edges of the doors. The light, then, will be incident at the door sill and by reflection therefrom reaches the light receivers. What is here a disadvantage is that the surface of the door sill must be suited for scattered reflections. This requires either specific materials or a specific surface finishing. In case of smoothing due to use, contamination or outside light, there may arise conditions under which the operation of such light barrier arrangement is no longer faultless.

SUMMARY OF THE INVENTION

Therefore with the foregoing in mind it is a primary object of the present invention to provide an improved construction of a light barrier arrangement which is designed to effectively and reliably control the automatic actuation of at least one lift cabin door.

Another and more specific object of the present invention aims at the provision of a new and improved construction of a light barrier arrangement designed to control the automatic actuation of at least one lift cabin door in which obstacles are detected in a limited region adjacent the closing edges of the door using non-reflected light.

Still a further significant object of the present invention is directed to a new and improved construction of a light barrier arrangement designed to control the automatic actuation of at least one lift cabin door in which the light exit places are prevented from becoming contaminated.

Now in order to implement these and still further objects of the invention, which will become more readily apparent as the description proceeds, the apparatus of the present development is manifested by the features that, each light emitter is actuated in the door sill, and each cabin door is provided with an entrainment element arranged to displace the light emitters synchronously with the movement of light receivers mounted at the cabin doors. Cleaning means or devices are provided at the bottom edges of the cabin doors, so that the light exit regions of the light emitters or transmitters through which the light emitted from said light emitters passes is cleaned during each opening and closing movements of the door.

The advantages achieved by the invention are essentially that in such an arrangement of the light emitters or transmitters the door sills can be manufactured substantially cheaper. Also, the light barrier arrangement operates more reliably, to which end the suggested cleaning means significantly contribute. Further advantages can be realised in that the guiding of the light emitters or transmitters by means of tubular brushes simultaneously renders possible the cleaning of the guide grooves or tracks, and due to operation of the light barriers with timewise-shifted infrared light pulse trains there can be operatively correlated different monitoring functions to the light beams and there can be eliminated the effect of foreign light.

When used in combination with a lift cabin door system which comprises two cabin doors defining a central closing line, according to further features of the present invention it is contemplated that each light emitter or transmitter contains a carriage or slide, a light source mounted on said carriage, a terminal or connection socket, a printed board assembly and two cleaning elements respectively mounted at the front and the rear end of the printed board assembly. Each carriage is placed into an associated groove or track and guided for axial movement therein. The printed board assembly carries the light source and the electrical connections therefor leading to the related terminal or connection socket, and said terminal socket is form-lockingly engaged by an entrainment element provided at the cabin door. In this way the cleaning elements serve the dual function of both guiding the light emitter carriages in the grooves or tracks and simultaneously cleaning said grooves.

According to a further feature of the present invention, each light source comprises two infrared pulse emitting sources, one of which is positioned closer and the other of which is positioned farther away from the central closing line of the cabin doors. The train of pulses generated by one of said light sources may be shifted in time from the train of pulses generated by the other of the light sources. Interruption of the train of pulses associated with the one light source and the train of pulses associated with the other of the light sources will, then, generate a control signal to reverse or to stop, respectively, the cabin door movement. In this way different monitoring functions may be associated with different trains of pulses and the effect of outside light can be accordingly eliminated.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
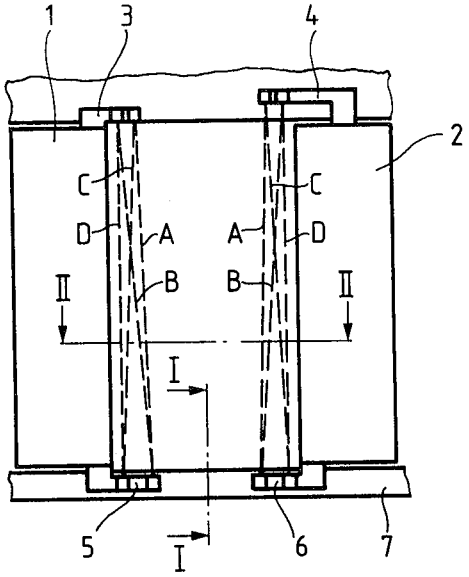
FIG. 1 is a schematic front view of a lift or elevator cabin with the automatic cabin doors shown in an open condition and provided with the light barrier arrangement according to the invention.

Describing now the drawings, it is to be understood that only enough of the construction of the lift or elevator system and the lift control has been shown as needed for those skilled in the art to readily understand the underlying principles and concepts of the present development, while simplifying the showing of the drawings. Turning now specifically to FIG. 1, there are illustrated by reference numerals 1 and 2 the doors of a lift or elevator cabin which are automatically operated in opposite directions. Vertically extending light barriers are arranged adjacent and forwardly of the closing edges of the cabin doors 1, 2. Each light barrier comprises a light receiver 3 and 4 mounted at the upper edge of the related cabin door 1 and 2, respectively, and a respective light emitter or transmitter 5 and 6 displaceably guided in a door sill 7 or the like. For the faultless closing of the doors 1 and 2, the light receivers 3 and 4 and the light emitters or transmitters 5 and 6 are displaced with respect to each other vertically and horizontally, respectively. The light receivers 3 and 4 may be constituted by commercially available sensors or receivers responsive to infrared radiation. Each of the light receivers 3 and 4 contains two signal transducers formed by phototransistors which are electrically connected to a suitable door control mechanism which does not form part of the invention and which is conventional in design.

Figure 2:
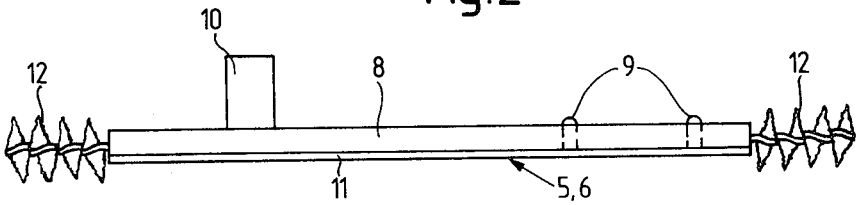
FIG. 2 shows on an enlarged scale a light emitter or transmitter of the light barrier arrangement shown in FIG. 1.

According to the showing of FIG. 2, the light transmitters or emitters 5 and 6 each comprise a carriage or slide 8, two infrared luminescent or light-emitting diodes 9, a terminal or connection socket 10, a printed board assembly 11 and a respective tubular brush 12 mounted at each end wall of the carriage or slide 8. The infrared luminescent diodes 9 are commercially available components and of conventional nature. The printed board assembly 11 fastened to the transmitter carriage 8 carries the infrared luminescent diodes 9 which project through suitable bores or apertures in the carriage 8; the printed board assembly 11 also provides for the electrical connection between the diodes 9 and the terminal or connection socket 10.

Figure 3:
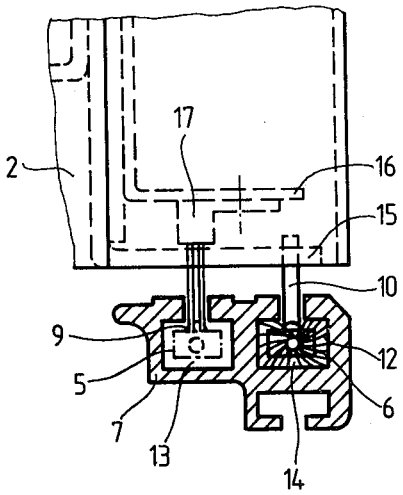
FIG. 3 is a cross-sectional view on an enlarged scale and taken substantially along the line I—I of FIG. 1.
Figure 4:
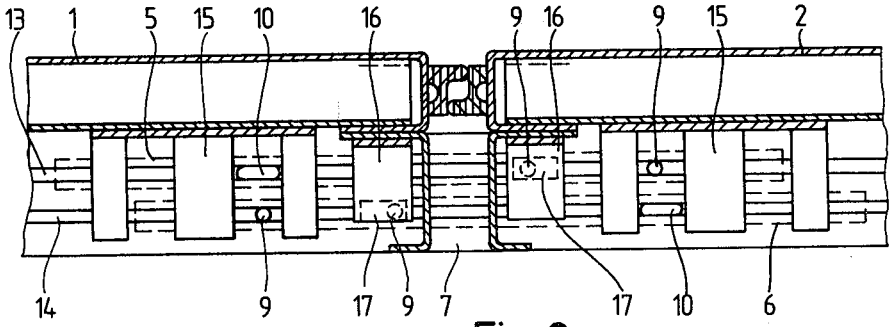
FIG. 4 is a cross-sectional view on an enlarged scale and taken substantially along the line II—II shown in FIG. 1 with the cabin doors closed.

Two horizontally adjacent grooves or tracks of substantially T-shaped cross-section are provided in the door sill 7; they are designated by reference numerals 13 and 14 in FIGS. 3 and 4. The one groove or track 13 is associated with the light emitter or transmitter 5 of the door 1 and the other groove or track 14 is associated with the light emitter or transmitter 6 of the other door 2. The carriage 8 of the light emitters 5, 6 is guided within the T-shaped grooves or tracks 13, 14 by means of the tubular brushes 12. Upon displacement of the light emitters or transmitters 5, 6 the grooves 13, 14 are cleaned and eventually present dirt is removed through holes provided in the bottom of the related groove or track. A respective bifurcated entrainment element 15 is mounted at each of the doors 1, 2. Each entrainment element 15 form-lockingly encloses the terminal or connection socket 10 of the respective light emitter 5 or 6, respectively, so that upon operation of the doors the light emitters 5 and 6 are displaced synchronously with the light receivers 3 and 4. A respective support or holder 16 mounted at each of the doors 1 and 2 supports cleaning means in the form of a respective wiper or brush 17 which extends into the T-shaped grooves or tracks 13, 14 for the purpose of cleaning the infrared luminescent diodes 9 of the light emitters 5, 6. The arrangement is carried out such that, when the doors 1 and 2 are moved, the cleaning brush 17 of the door 1 will clean the infrared luminescent or light-emitting diodes 9 of the light emitter 6 associated with the other door 2 and vice versa. Support 16 and cleaning brush 17 are designed in such a way that such an arrangement is realized in a most simple manner by simply rotating the one cleaning brush 17 by 180° with respect to the other.

Preferably, the light barrier arrangement as described hereinbefore operates with pulses of infrared light or radiation. The train of pulses emitted by the two luminescent diodes 9 of each one of the light emitters 5 and 6 are displaced in time with respect to one another.

Consequently, different paths of the rays or beams A, B, C, D (FIG. 1) may be associated with different monitoring functions. Thus in case that the path of rays or the beam A and/or the path of rays or the beam B is interrupted, which both originate from a luminescent diode 9 which is farther from the door closing edge, a control signal will be generated which will effect interruption of the closing movement of the doors. If, however, the path of rays or beam C and/or the path of rays or beam D is interrupted, which originates from the luminescent diode 9 closer to the door closing edge, a control signal will be generated which will reverse the door drive, but only for as long as the paths of the rays or beams C and/or D are interrupted. Consequently, there will be achieved the result that, on the one hand, a closing movement of the doors will be stopped prior to the door closing edge abutting a solid obstacle, such as for example pallets, a piece of furniture, such as a bed, or the like. On the other hand, there will be also achieved the result that reversal of the door movement is already initiated at a greater distance from the door closing edge if the path of rays or beam C is interrupted at the upper region, for example by the head or the shoulders of a lift user. Additionally, the cross-wise extending paths of the rays or beams B and C may be evaluated for detection within the central region of the light barrier of objects positioned in the region between the exterior path of the rays or beam A and the interior path of the rays or beam D as, for example, at the level of the hands of a lift user.

While there are shown and described present preferred embodiments of the invention, it is to be distinctly understood that the invention is not limited thereto, but may be otherwise variously embodied and practiced within the scope of the following claims. Accordingly,

What we claim is:

1. A light barrier arrangement for controlling the automatic actuation of two cabin doors of a lift, said light barrier arrangement comprising:

at least one respective light receiver connected to each lift cabin door and arranged to be displaced together with the related cabin door;

at least one respective light emitter operatively associated with each light receiver;

each said light emitter being mounted displaceably in a door sill and each said light receiver, in a predetermined position of the related cabin door, being located vertically above the related light emitter;

each cabin door being provided with an entrainment element for entraining the related light emitter during the movement of such cabin door; and cleaning means provided at a bottom edge of each cabin door, so that the region of the door sill through which passes the light emitted from the light emitters is cleaned during each of the opening and closing movements of the cabin doors.

2. The light barrier arrangement as defined in claim 1, further including:

two substantially T-shaped grooves provided in said door sill; and one of said two grooves accommodating the light emitter of one of the cabin doors and the other groove accommodating the light emitter of the other of the cabin doors.

3. The light barrier arrangement as defined in claim 2, wherein:

each light emitter comprises:

a transmitter carriage;

a light source mounted at said transmitter carriage;

a terminal socket;

a printed board assembly; and two cleaning elements mounted at a respective front end and rear end of said printed board assembly;

each said transmitter carriage being arranged in an associated one of said grooves and being guided for substantially axial movement therein by said cleaning elements;

said printed board assembly carrying said light source and electrical connections therefor leading to said terminal socket; and said terminal socket being form-lockingly engaged by a related entrainment element.

4. The light barrier arrangement as defined in claim 3, wherein:

said two cabin doors defining a central closing line;

each light source comprising two infrared-pulse emitting sources;

one of said light sources being positioned closer to said central closing line and the other of said light sources being positioned farther away from said central closing line;

a train of pulse generated by one of said light sources being shifted in time with respect to a train of pulses generated by the other of said light sources; and interruption of the train of pulses associated with one of said light sources and said train of pulses associated with the other of said light sources generating a respective control signal for reversing or stopping the cabin door movement.

5. The light barrier arrangement as defined in claim 3, wherein:

each of said cleaning means of each cabin door comprising at least one cleaning brush mounted at a support of the related cabin door;

said cleaning brush extending into the groove associated with the other of said two cabin doors so that the cleaning brush of said one of said two cabin doors acts to clean the light source mounted at said transmitter carriage at the other one of said two cabin doors and vice versa when said two cabin doors are moved.

6. The light barrier arrangement as defined in claim 3, wherein:

each of said cabin doors has a door closing edge;

each of said light emitters comprising two light-emitting diodes which radiate infrared light pulses in the form of pulse trains; and the pulse trains of both infrared light-emitting diodes of each light emitter being shifted in time with respect to one another, so that upon interruption of a light beam emitted by one of the light-emitting diodes located at a smaller spacing from the door closing edge there is generated a control signal which reverses cabin door movement and upon interruption of a beam of light emanating from the light-emitting diode located at a greater spacing from the door closing edge there is generated a control signal which only stops the cabin door movement.

* * * * *